US006241602B1

(12) United States Patent
Allen

(10) Patent No.: US 6,241,602 B1
(45) Date of Patent: Jun. 5, 2001

(54) GABLE END ROOF VENTILATOR

(76) Inventor: Robert Charles Allen, PO Box 44, Edge Hill, Cairns 4870 (AU)

( * ) Notice: Subject to any disclaimer, the term of this patent is extended or adjusted under 35 U.S.C. 154(b) by 0 days.

(21) Appl. No.: 09/307,535

(22) Filed: May 7, 1999

(51) Int. Cl.[7] ..... F24F 7/00

(52) U.S. Cl. ..... 454/280; 52/199; 454/277; 454/367

(58) Field of Search ..... 454/237, 276, 454/277, 280, 283, 339, 367; D25/56; 52/302.3, 199

(56) References Cited

U.S. PATENT DOCUMENTS

| | | | | |
|---|---|---|---|---|
| D. 134,337 | * | 11/1942 | Cutshall | 454/367 X |
| 2,645,992 | * | 7/1953 | Simblest | 454/277 |
| 2,855,841 | * | 10/1958 | Smith et al. | 454/280 X |
| 2,923,228 | * | 2/1960 | Fitterman | 454/277 |
| 2,988,983 | * | 6/1961 | Davis | 454/283 X |
| 3,777,649 | * | 12/1973 | Luckey . | |
| 4,785,596 | | 11/1988 | Wiley et al. | 52/302 |
| 4,911,066 | | 3/1990 | Carew . | |
| 5,349,799 | | 9/1994 | Schiedegger et al. | 52/473 |

FOREIGN PATENT DOCUMENTS

| | | | | |
|---|---|---|---|---|
| 1355553 | * | 6/1974 | (GB) | 454/212 |

* cited by examiner

*Primary Examiner*—Harold Joyce
(74) *Attorney, Agent, or Firm*—Roy Kiesel & Tucker

(57) ABSTRACT

A gable roof end ventilator comprises a triangular vented member with peripheral mounting flanges, the flanges each lying in a plane inclined relative to the plane of the vented member. The ventilator accommodates variations in roof pitch by tilting the ventilator about its base relative to the plane of an end wall of a building and then securing the ventilator to the end wall and eaves of the building by fasteners through the mounting flanges.

5 Claims, 5 Drawing Sheets

FIG. 1
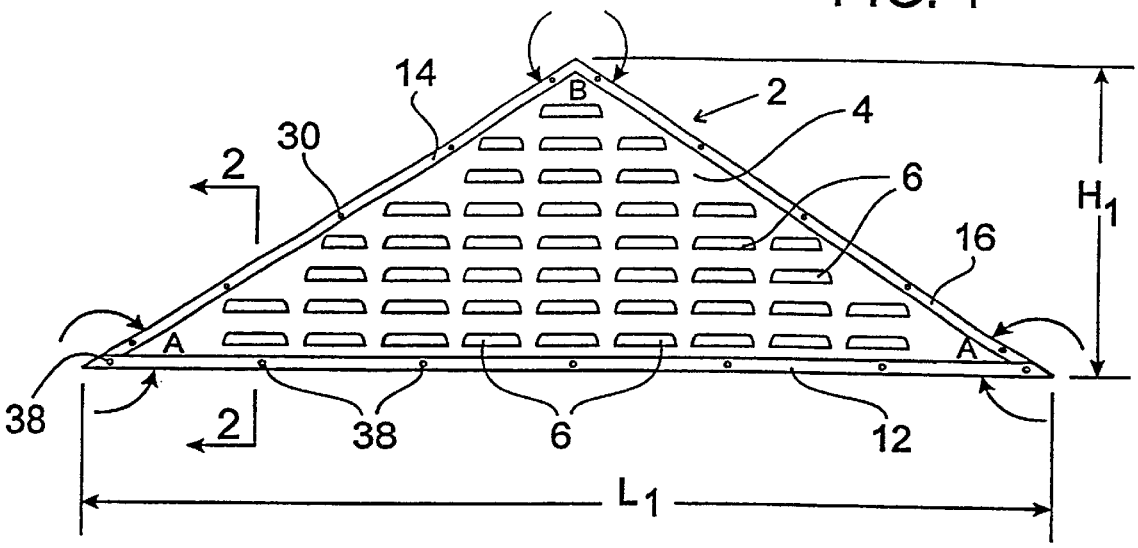
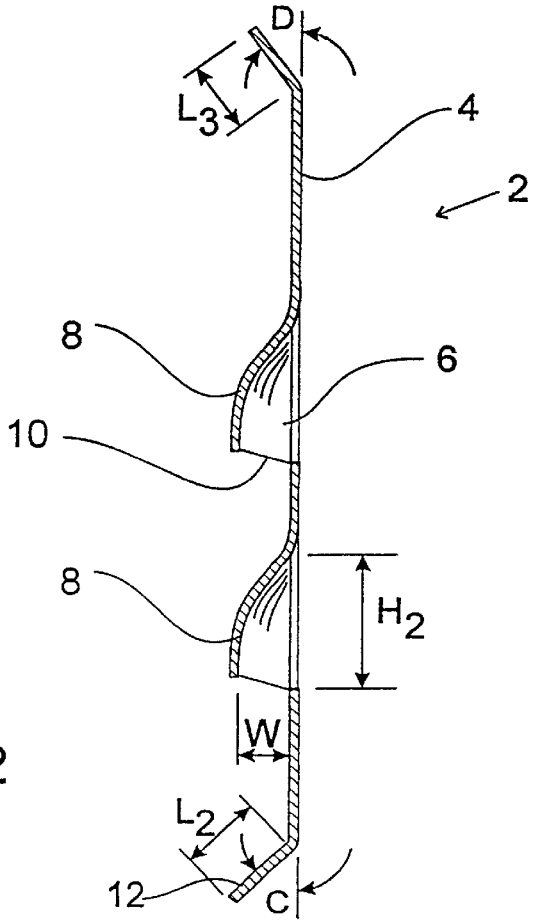
FIG. 2

20
22
24
26
16
2
6
4
12
28
30
32
34

GABLE END ROOF VENTILATOR

This invention relates to the ventilation of the roof space of buildings of the style which have a gable roof, and, in particular to a ventilator by which to achieve ventilation and a method by which to install the ventilator.

In building structures having a gabled roof, there is a need to ventilate the air space beneath the roof, and above the ceiling, to remove hot air, particularly in warmer climates, and in colder climates to reduce condensation and mould growth due to moisture laden air.

Typically, roof space ventilation is achieved by locating a louvred frame between adjacent studs in the opposite end walls of a building adjacent the gable peaks. These ventilators have fixed louvre blades which are spaced at about 50mm intervals and which are inclined outwardly and downwardly parallel to each other. A bird wire mesh is typically located on the inner side of the ventilator or gable frame to prevent birds from entering the roof space therebehind. In warmer climates these integrally constructed ventilators generally are much larger than those employed in cooler climates.

There are many problems associated with such roof ventilating systems.

A major disadvantage is associated with the cost of constructing and installing the ventilators, usually during construction of the building. Another major disadvantage of these prior art ventilators is that in warmer climates, particularly tropical and sub tropical regions prone to tropical rain storms, these ventilators permit the ingress of substantial amounts of rainwater when the rain storm is accompanied by gusty swirling winds. Yet another disadvantage is that the large rectangular ventilator structure is positioned well below the roof gable thus permitting the retention of a substantial body of hot air.

While rotating vents fitted to the outside of the roof on the gable are initially effective in removing hot air from the roof space, the limited life of their bearing systems leads to failure and high maintenance costs. Such rotating vents are also prone to storm damage in tropical and sub-tropical regions.

From an aesthetic view point, the large expanse of planar end walls of gable roofed house is quite unattractively disturbed by the rectangular louvred ventilator structures. To add an element of architectural interest to these plain end walls it is common to mount a decorative panel adjacent the ventilator (usually beneath). However such a combination is architecturally contradictory. There is therefore a need to resolve this conflict between functionality and aesthetic appearance.

Accordingly it is an aim of the present invention to overcome or ameliorate at least some of the problems associated with prior art roof space ventilators for buildings with gabled roof structure.

According to the present invention there is provided a ventilator for a building having a gable roof, gable wall and eaves, said ventilator including:

a substantially triangular panel; and means for fixing the ventilator to a gable wall and/or associated eaves;

said panel being formed with a plurality of ventilation openings therein.

Preferably, the above defined panel is in the form of an isosceles triangle. Further, the means for fixing the ventilator preferably includes at least one peripheral flange. Ideally the panel is generally planar and the flange extends along one side thereof. The flange is preferably mounted at an angle relative to the plane of the panel. Preferably, the other two sides of the panel include mounting flanges. The panel ideally includes an apex which has an obtuse angle preferably in the range 100 to 150 degrees.

If required the ventilator may include a further panel extending downwardly of a base of the generally triangular panel. The further panel may include ventilation openings therein. Alternatively or additionally, the further panel may comprise in whole or in part a decorative panel or panel portion.

Suitably the ventilator may include or incorporate movable or adjustable ventilation openings. Preferably adjustable ventilation openings are movable between an open and a closed position. If required, the ventilator may include a suitable actuation means by which to selectively move or operatively adjust said ventilation openings between an open and a closed position. The actuation means may comprise any of a mechanical, electrical, electromechanical or thermoresponsive means.

The invention also provides a method of establishing roof ventilation including the steps of:

positioning a ventilator as defined above beneath a gable, tilted forwards until its perimeter abuts the associated gable wall and respective eaves along its edges;

marking the gable wall to delineate the area covered;

making an opening in the gable wall above the mark;

repositioning the ventilator to cover the opening;

fixing the ventilator at its bottom edge to the gable wall, tipped forwardly beneath the gable; and fixing the ventilator to the eaves along its upper edges.

In use of the invention, part of the gable end wall can be removed and the triangular panel can be located so as to cover the opening. Because gable rooves are made at various pitches, normally the orientation of the ventilator panel will not be coplanar with respect to the plane of the gable wall. The orientation of the ventilator panel can be adjusted so that the apex of the panel engages the point where the eaves meet beneath the gable and the two shorter sides of the panel will engage or lie adjacent to the eaves. The mounting flange of the ventilator can then extend at an appropriate angle so that it can be fixed to the remaining part of the gable end wall. In this manner a single ventilator or limited range of ventilators can be fitted accurately and neatly to buildings with a wide range of roof gable angles.

The device of the invention can be formed from sheet metal. Alternatively it could be moulded from plastics material so as to have the appearance of wooden ventilator slats or the like.

In order that the invention may be more readily understood and put into practical effect, preferred embodiments will now be further described with reference to the accompanying drawings, in which:

FIG. 1 is a side view of a ventilator of the invention;

FIG. 2 is a cross-sectional view along the line 2—2 of FIG. 1;

Figure 3:
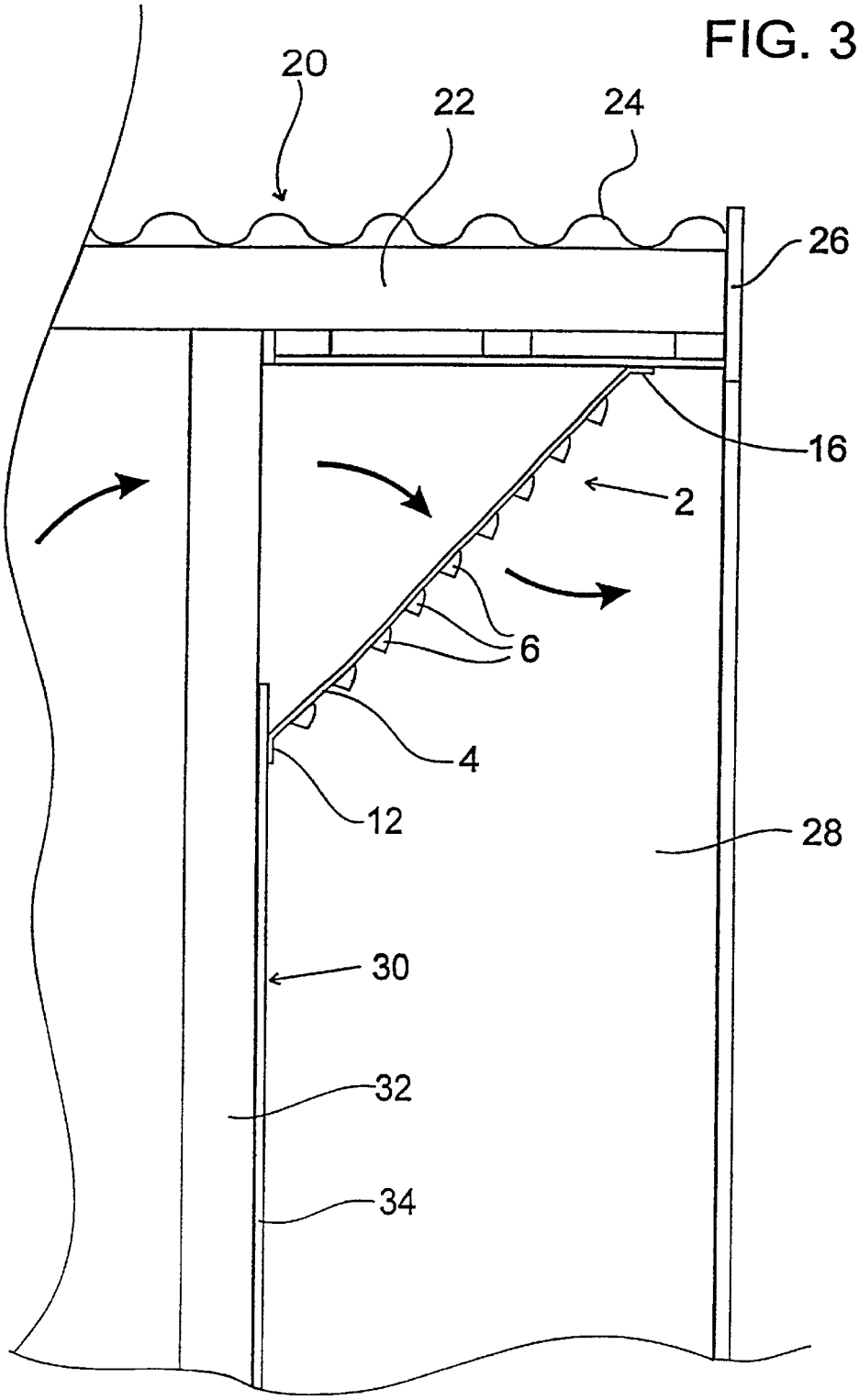
FIG. 3 is a section through a building having a gable roof to which the ventilator of the invention has been fitted.

FIGS. 1 and 2 show an embodiment of a ventilator 2 in accordance with the invention. The ventilator of this embodiment is preferably formed in or from a section or piece of sheet metal, such as aluminium, or the like, typically, in the case of aluminium, having a thickness in the range 1.2 mm to 2 mm and preferably 1.6 mm. The ventilator 2 may include or comprise a substantially or generally triangular panel 4, in which may be established or formed a plurality or array of ventilator openings or passageways 6. In the illustrated embodiment, the ventilator openings 6 may be formed by a process such as pressing, in which both the openings and the cover members 8 are formed, being projected outwardly or away from the plane defined by the original sheet material from which the panel 4 is formed (hereinafter referred to as the plane of the panel) so as to define downwardly facing (in the context of the panel in use), gaps 10 which open over or lead to the ventilator openings 6. The panel 4 may ideally include a base mounting flange 12 and/or, preferably, side mounting flanges 14 and 16 along the other two sides. As best seen in FIG. 2, the base mounting flange 12 may be longer than the flanges 14 and 16. The flange 12 may be formed to make an angle C with respect to the plane of the panel 4. The angle C is normally in the range 40 to 60 degrees and preferably 50 degrees. At the same time the flanges 14 and 16 are ideally also inclined to the plane of the panel 4 at an angle D. Normally the angle D is in the range 5 to 20 degrees and preferably 10. It has been found that a choice of angles as defined above enables more flexibility in the mounting of the ventilator 2, as will be described below in greater detail. The panel 4 is preferably an isosceles triangle, ideally having an obtuse angle B at its apex. Preferably B is in the range 100 to 140 degrees. Preferably also the acute angles A are equal and are in the range 20 to 40 degrees.

Figure 4:
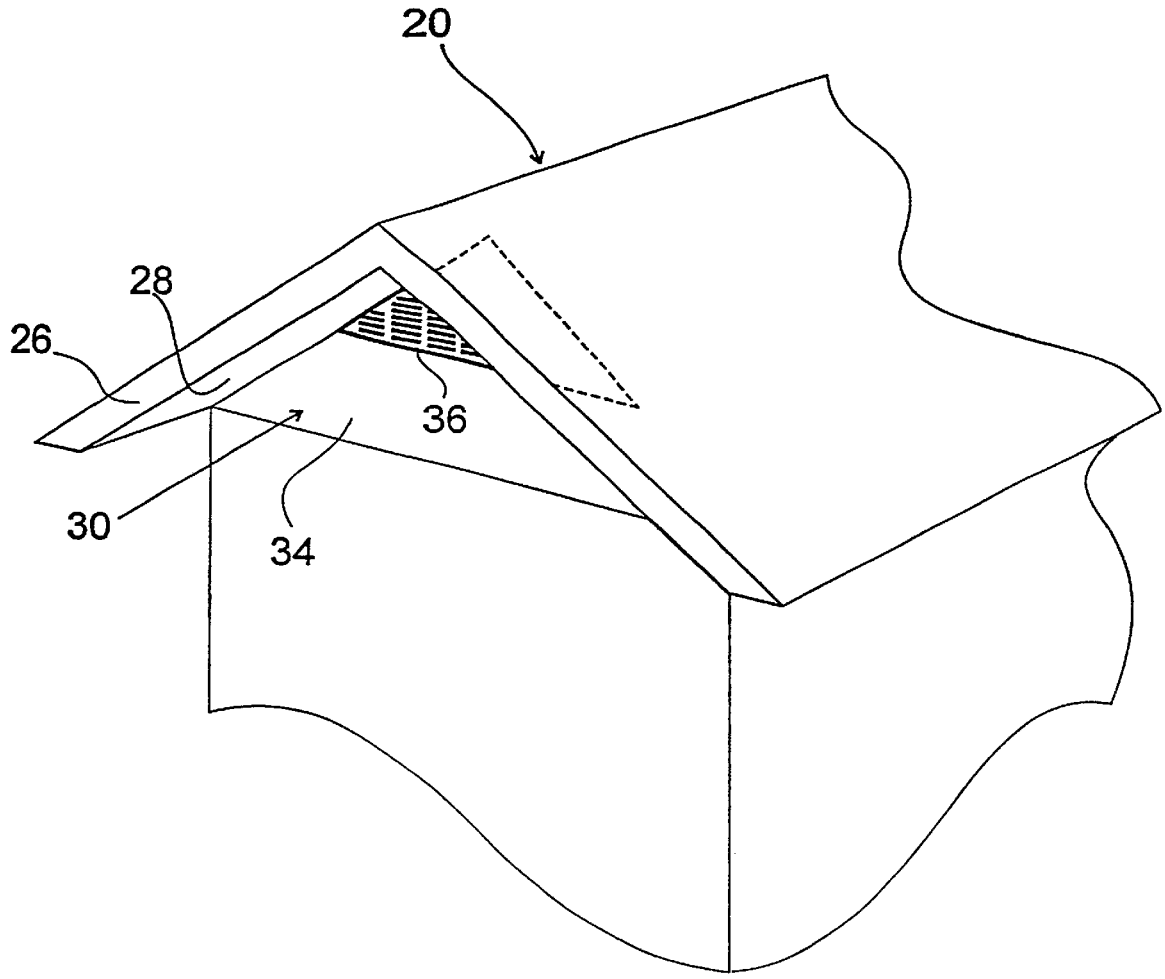
FIGS. 4 and 5 are schematic drawings showing installation of the ventilator of the invention.
Figure 5:
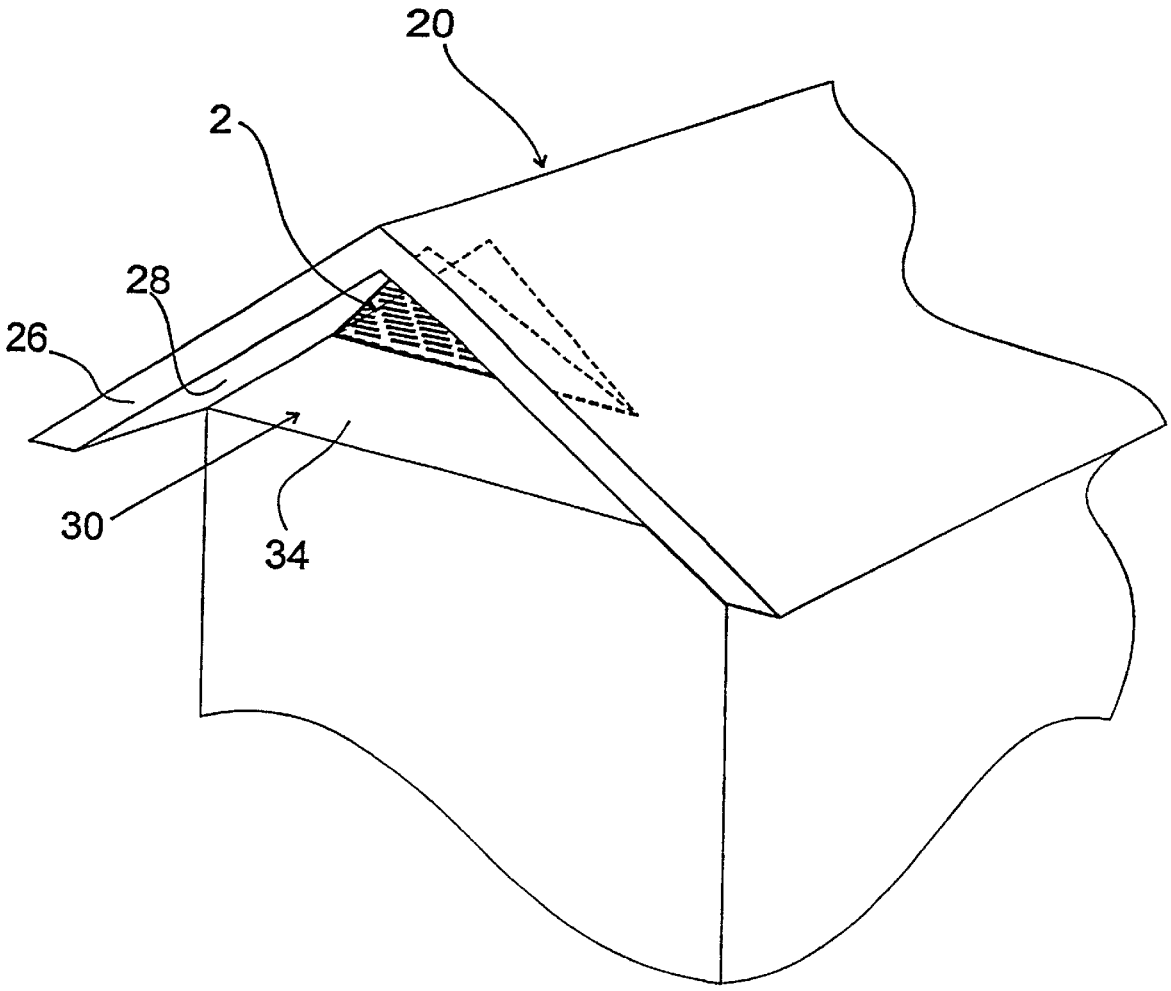

FIGS. 3, 4 and 5 diagrammatically illustrate the way in which the ventilator 2 can be mounted in a building having a gable roof 20. The roof 20 may include a ridge beam 22, roofing material 24, barge board 26 and eaves 28. The building may include a gable wall 30 which may include a stud 32 and cladding material 34. It will be seen from FIG. 4 that the ventilator 2 can be mounted in a plane which is inclined to the plane of the wall 30, but the flanges 12, 14 and 16 can engage or lie closely adjacent to the wall 30, and eaves 28 respectively. The orientation or tilt of the ventilator 2 can be adjusted so that all of the flanges engage the respective parts or elements of the building.

The preferred way of mounting the ventilator 2 is to place the ventilator so that its apex is located at the junction of the eaves 28. The orientation of the ventilator 2 is then adjusted until the flanges 12, 14 and 16 engage the wall 30 and eaves 28 respectively. The installer can then mark a line 36 on the wall 30 where the flange 12 will be located, as shown in FIG. 4. The cladding 34 above the line 36 can then be removed as shown by the cross-hatching in FIG. 4. This forms a hole in the end wall to enable ventilation of the roof. The hole is covered by the ventilator 2. The flanges 12, 14 and 16 are preferably formed with holes 38 to facilitate mounting of the ventilator. Self tapping screws and the like can be used to fix the flanges directly to the cladding 34 and the eaves 28. Because of the orientation of the flanges 12, 14 and 16 described above, they will lie approximately flush with the wall 30 and eaves 28 over a reasonably broad range of pitch angles for the roof.

It is proposed that two sizes for the ventilator 2 can be made to cover most applications. Detail of these are set out in Table 1 below. Model 1 is suitable for rooves having a pitch angle in the range 20 to 30 degrees. Model 2 is suitable for rooves having a pitch angle in the range 10 to 20 degrees.

TABLE 1

| | MODEL 1 | MODEL 2 |
|---|---|---|
| Length L1 | 1200 mm | 1500 mm |
| Height H1 | 450 mm | 300 mm |
| Length L2 | 15 mm | 15 mm |
| Length L3 | 10 mm | 10 mm |

It will be appreciated of course that the eaves must have sufficient overhang to enable mounting of the ventilator as described above.

The ventilator 2 of the invention can be fitted to new buildings or can be retrofitted to existing buildings such as domestic houses, commercial buildings, factories and the like. The orientation of the panel 4 generally ensure that water will not pass therethrough to the interior of the roof. The ventilator covers 8 assist in this. Also, it may be desirable to locate washers (not shown) between the mounting flange 12 and the cladding material 34 so as to create a small gap to permit escape of any water which may happen to run down the inner face of the panel 4.

Preferably the width W of the gap 10 is in the range 5 mm to 10 mm and preferably 6 mm so as to minimise the likelihood of pests entering through the opening 6.

The ventilator described above is preferably formed from a single piece of sheet metal. It is to be understood, however, that the principles of the invention could also be put into practice by means of an injection moulded element which has a desirable decorative appearance such as wooden slats or the like.

Figure 6:
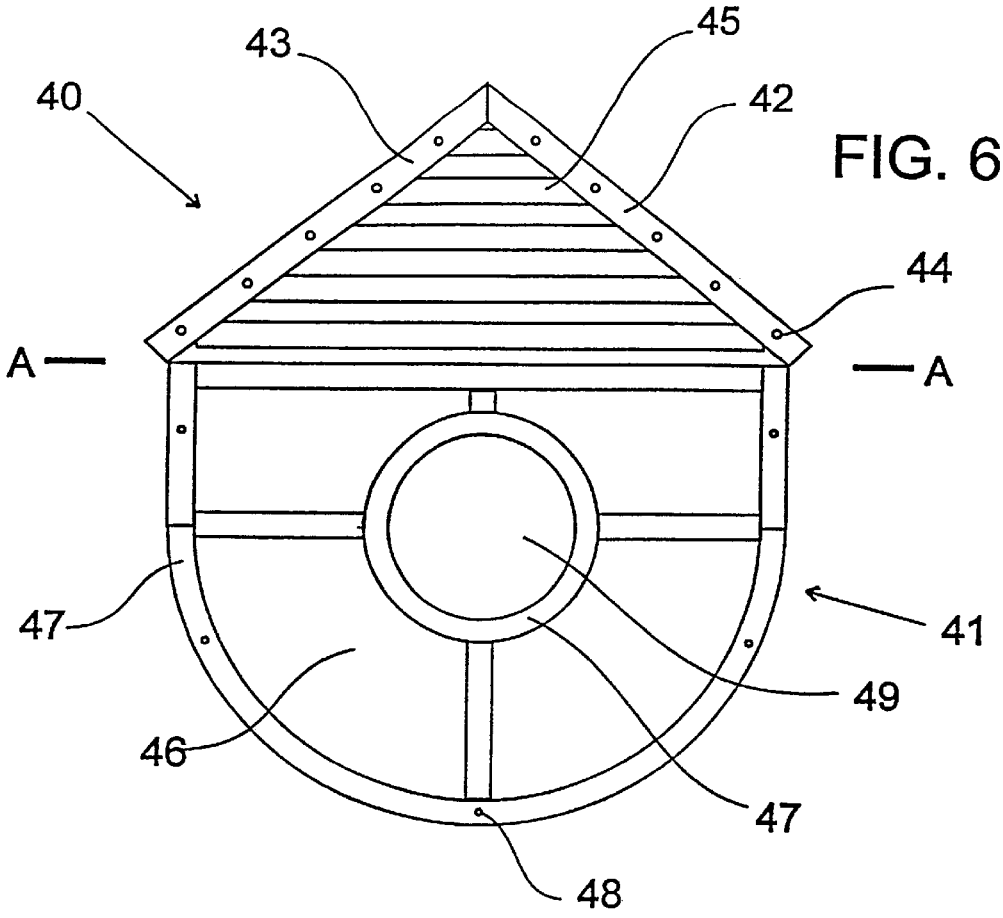
FIG. 6 shows a ventilator with an attached decorative panel.

In FIG. 6 the ventilator assembly includes a generally triangular ventilator panel 40 and a decorative or additionally functional panel shown generally at 41. The triangular ventilator panel 40 is attached to further panel 41 such that it may be inclined about axis A—A relative to panel 41. The attachment between panels 40, 41 may be hinged or it may be a flexible metal or plastics connection. Surrounding the upper perimeter of ventilator panel are mounting flanges 42, 43 having a plurality of apertures 44 to receive mounting screws or the like. Louvre blades 45 may be pivotally mounted to a support frame (not shown) associated with the triangular panel 40. These blades may be selectively moved between an open and closed position by an suitable actuation means such as mechanical, electrical, electromechanical or thermoresponsive means and the actuation may be manual or automatic. The decorative/functional panel 41 may include a planar backing panel 46 which can be painted if required or some or all of the interstices between the frame components 47 may include decorative elements such as coloured glass or plastics material. Perimetal frame 47 suitably includes mounting apertures 48. If required, one or more of the backing elements or decorative elements in frame 47 may also function as a ventilating means. For example 49 may be pivotal about an upright or horizontal axis and movable between an open and closed position to provide additional ventilation.

Figure 7:
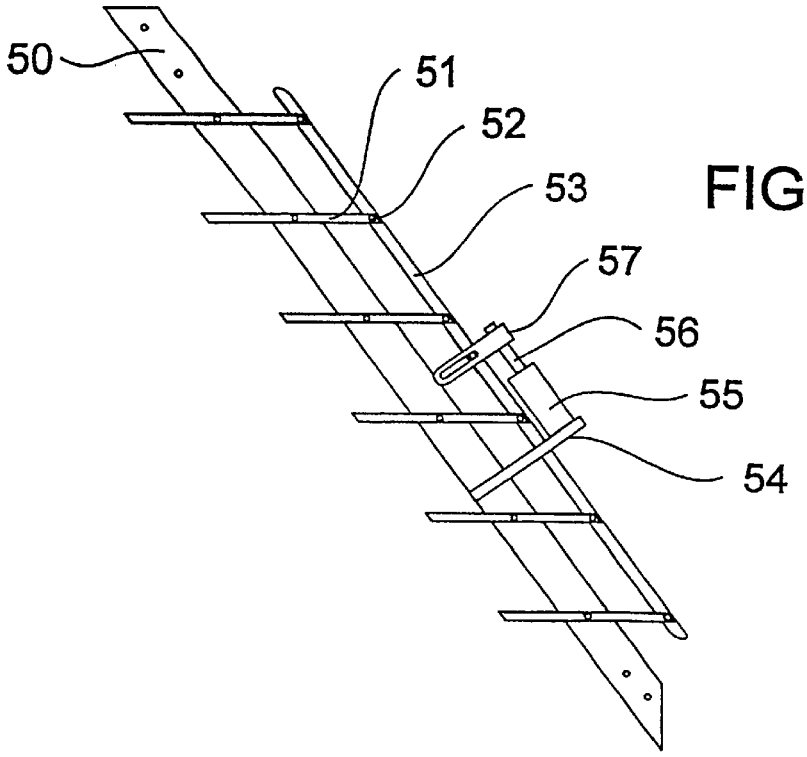
FIG. 7 shows schematically in cross section a thermo-actuated ventilator assembly.

FIG. 7 shows schematically an automatic ventilator actuator system. Within the perimeter of the triangular panel bounded by mounting flanges 50 is a planar support frame (not shown) to which the louvre blades 51 are pivotally mounted at opposite ends thereof. Attached to the rear edge of each louvre blade is an eye member 52 and each eye member 52 is pivotally connected to a link rod 53 so that all louvres move in unison between an open and a closed position. A mounting bracket 54 bridges the support frame and secured thereto is a thermoresponsive piston and cylinder assembly 55 or alternatively a diaphragm member (not shown) expandable under the influence of a temperature increase to cause mechanical motion. In the apparatus shown the piston rod 56 is coupled to link rod 53 by a slidable lost motion coupling 57. The ventilator is adapted to cause progressive opening of the louvres 51 as the ambient air temperature rises above a predetermined value. In the event of a rain storm which is usually preceded by a drop in ambient air temperature, the louvres 51 are progressively rotated to a closed position to prevent ingress of rain water. As an alternative to a thermoresponsive louvre actuation means, an externally mounted electrical rain detection element may be coupled to an electrically powered louvre actuation means.

Many modifications will be apparent to those skilled in the art without departing from the spirit and scope of the invention.

What is claimed is:

1. A method of gable roof ventilation including the steps of:

positioning a triangular ventilator having angled peripheral mounting flanges beneath a gable, said ventilator being tilted forwards until its perimeter abuts the associated gable wall and respective eaves along its edges;

marking the gable wall to delineate the area covered;

making an opening in the gable wall above the mark;

repositioning the ventilator to cover the opening;

fixing the ventilator at its bottom edge to the gable wall, tipped forwardly beneath the gable; and fixing the ventilator to the eaves along its upper edges.

2. The method of gable roof ventilation according to claim 1 wherein said ventilator further comprises:

a substantially triangular panel having a base and inclined sides terminated in an apex; and peripheral mounting flanges for fixing the ventilator to a gable wall and/or associated eaves;

said panel being formed with a plurality of ventilation openings therein, said ventilator characterized in that said flanges are mounted at an acute angle relative to a plane of said panel to permit, in use, inclined mounting of said panel relative to respective planes of said gable wall and said eaves.

3. The method of gable roof ventilation according to claim 2 wherein said triangular panel is formed as an isosceles triangle.

4. The method of gable roof ventilation according to claim 3 wherein said apex has an included angle in the range of from 100 to 140 degrees.

5. The method of gable roof ventilation according to claim 4 wherein said ventilation openings are formed as elongate apertures with outwardly projecting cover members.

* * * * *